United States Patent [19]

Bakker et al.

[11] Patent Number: 4,639,636

[45] Date of Patent: Jan. 27, 1987

[54] COLOR DISPLAY TUBE WINDOW, SKIRT AND MOUNT FOR COLOR SELECTION MEANS

[75] Inventors: Gijsbertus Bakker; Gerhardus J. Rorije, both of Eindhoven, Netherlands

[73] Assignee: U.S. Philips Corporation, Tarrytown, N.Y.

[21] Appl. No.: 607,359

[22] Filed: May 4, 1984

[30] Foreign Application Priority Data

Dec. 6, 1983 [NL] Netherlands ..... 8304179

[51] Int. Cl.[4] ..... H01J 29/07; H01J 29/24

[52] U.S. Cl. ..... 313/408; 313/477 R; 220/2.1 A

[58] Field of Search ..... 313/402, 408, 461, 477 R, 313/474, 478; 220/2.1 A, 2.3 A; 358/250

[56] References Cited

U.S. PATENT DOCUMENTS 4,358,702 11/1982 Gijrath et al. ..... 313/404

FOREIGN PATENT DOCUMENTS 11569 2/1978 Japan ..... 313/402

1358161 6/1974 United Kingdom ..... 313/477

OTHER PUBLICATIONS

Journal of Electronic Engineering; Aug. 1982; p. 24 (Japan); Toshiba's New CRT Realizes Almost Flat TV Screen.

*Primary Examiner*—Palmer C. DeMeo
*Assistant Examiner*—K. Wieder
*Attorney, Agent, or Firm*—John C. Fox

[57] ABSTRACT

A color display tube comprising a display window which changes into a skirt which is substantially parallel to the axis of the tube via a strongly curved part. The inner surface of the window changes into the inner surface of the skirt via a strongly curved surface having a radius of curvature r. The outer surface of the window changes into the outer surface of the skirt via a strongly curved surface. The display window comprises on its inside a substantially rectangular display screen and a shadow mask at a short distance in front of the display screen, which mask is supported in the corners of the display window by suspension means fixed in the skirt. In the proximity of the strongly curved transition the skirt has a thickness d. In a plane perpendicular to the tube axis the distance D between the boundary of the luminescent material of the display screen and the outer surface of the skirt throughout the circumference of the window is substantially equally large and for $r \leqq 10$ mm satisfies the condition that $(D-d)/r \leqq 1$.

2 Claims, 8 Drawing Figures

COLOR DISPLAY TUBE WINDOW, SKIRT AND MOUNT FOR COLOR SELECTION MEANS

BACKGROUND OF THE INVENTION

The invention relates to a colour display tube comprising an envelope consisting of a neck, a cone and a flat or slightly convex display window which changes into a skirt which is substantially parallel to the axis of the envelope via a strongly curved part, the inner surface of the display window changing into the inner surface of said skirt via a first strongly curved surface having a radius of curvature r and the outer surface of the display window changing into the outer surface of said skirt via a second strongly curved surface, the skirt, in the proximity of said transition, having a thickness d, the display window comprising on its inside a substantially rectangular display screen which comprises a material luminescing in at least one colour, colour selection means being positioned in front of said display screen by means of suspension means fixed in the skirt, means being provided in said neck to generate at least one electron beam.

The invention furthermore relates to a display device having such a display tube.

Recent developments of display tubes go more and more towards flatter display windows, as described for example, in Journal of Electronic Engineering, August 1982, p. 24. In said publication it concerns a colour display tube having a substantially rectangular display screen, in which, however, the outer contour of the display window is slightly barrel-shaped.

In colour display tubes it is usual to fix the suspension means for the colour selection means in the long and short sides of the skirt of the display window. The suspension means usually consist of metal pins which are sealed in the skirt and which each extend in an aperture of metal resilient strips connected to the colour selection means. Said metal strips are connected to a skirt of the colour selection means which also extends substantially parallel to the axis of the envelope. It will be obvious that for such a suspension construction quite some space is necessary between the skirt of the display window and the skirt of the colour selection means. For this reason, the inner contour of the skirt of the display window is constructed so as to be slightly more barrel-shaped than the contour of the skirt of the colour selection means. For tubes which are placed in a cabinet and the outer circumference of which is screened from the viewer by a fillet, this need not be an objection because the inner edge of the fillet may adjoin the edge of the display screen. However, for tubes the display window of which projects slightly beyond the cabinet (so-called push-through mounting) and the fillet can hence not be used, the substantially rectangular display screen on the inner wall of the much less rectangular display window leads to dark areas above and below and on the left and on the right of the display picture, which areas vary in width and are annoying to the viewer. This undesired effect is even more intensified by the fact that the outer contour of the display window and hence the outer contour of the skirt of the display window, in itself is constructed to be more barrel-shaped than the inner contour of the skirt of the display window. This design is assumed to be necessary in connection with the stringent requirements as regards implosion safety for the tube.

SUMMARY OF THE INVENTION

It is the object of the invention to provide a display tube which is particularly suitable for push-through mounting and which does not exhibit the above-mentioned annoying dark areas.

According to the invention, a colour display tube of the kind mentioned in the opening paragraph is characterized in that the suspension means for the colour selection means are connected in the corners of the skirt and that the distance D in a plane perpendicular to the tube axis between the boundary of the luminescent material of the display screen and the outer surface of the skirt of the display window is substantially equally large throughout the circumference of the window and that for $r \leqq 10$ mm the following condition is satisfied $(D-d)/r \leqq 1$.

By using the invention only a narrow dark edge which has substantially the same width nearly everywhere is obtained around the rectangular display screen which still emphasizes the rectangularity of the display screen. Moreover said narrow dark edge which has substantially the same width nearly everywhere, in an operating tube leads to a picture presentation which is attractive to the viewer. Notably, said edge does not lead to a perceptive distortion of, for example, a number of straight columns of digits displayed on the display screen. In an non-operating tube the narrow edge around the display screen which has substantially the same width everywhere results in an aesthetic design. Experiments and comparative calculations have moreover demonstrated that a display window having a substantially rectangular outer contour does not lose implosion safety both under static and dynamic loads as compared with the known tube which has a substantially flat display window and a barrel-shaped contour.

The invention advantageously uses the larger space which is present in the four corners of the display screen between the skirt of the display window and the skirt of the colour selection means. With a substantially rectangular inner contour of the display window and a substantially rectangular contour of the skirt of the colour selection means, the gain in space is at least a factor $\sqrt{2}$ with respect to the centres of the sides of the said rectangles. By using the invention said gain in space can be effectively used in that sense that the boundary of the luminescent material of the display screen, in contrast with the known display tube, may extend along the inner contour of the display window. In this manner an optimum size of the display screen on the display window is obtained. This is of importance for tubes having black matrix material between the elements of luminescent material of the display screen, said matrix material extending to beyond the boundary of the luminescent material of the display screen. However, thisis also of importance for tubes without said matrix material in which an aluminum film ("metal backing") is provided over the luminescent material so as to extend to beyond the boundary of the luminescent material. As a matter of fact, in the former case a wide non-uniform dark edge is formed without using the invention and in the latter case a shining non-uniform edge (aluminum) surrounded by a dark edge caused by the skirt of the display window is formed.

The importance of and the need for a suspension of the colour selection means in the corners of the display window is particularly great in display tubes having a substantially flat display window, that is having a large radius of curvature of the display window. As a matter of fact, in the case of flatter display windows, the colour selection means which are placed, for example, in the form of a shadow mask plate at a short distance before the display screen, would have to be constructed so as to be flatter. Temperature differences which may occur during operation of the tube over the surface of the shadow mask and which result in a local or complete bulging of the shadow mask, in flatter shadow masks will lead to coarser colour defects in the displayed picture. In behalf of the mechanical rigidity in a suspension of the shadow mask from the centre of the sides, the skirt of the shadow mask is connected to a supporting frame of thicker sheet material than the mask itself. Said supporting frame also is a diaphragm to prevent reflections of electrons at the skirt of the shadow mask. This in itself sooner results in temperature differences between the skirt of the shadow mask and the shadow mask itself. By using the invention, however, the thickness of said diaphragm can be adapted to that of the shadow mask itself because the mechanical rigidity of the shadow mask in the corners is sufficiently large to be able to realize a suspension in those places.

It is to be noted that for this latter reason it is known per se to suspend the colour selection means in the corners of the display window.

An additional advantage of the suspension of the colour selection means in the corners of the display window is that the suspension construction itself can be constructed with simple means. It is known to compensate for the thermal expansion of the shadow mask by means of a displacement of the shadow mask in the direction of the display screen. For that purpose it is conventional to suspend the shadow mask from the pins sealed in the skirt of the display window by means of bimetallic elements. In a suspension in the corners said bimetallic elements may be replaced by simple metal strips the longitudinal direction of which in each corner is substantially perpendicularly to the electron beam deflected towards said corner.

BRIEF DESCRIPTION OF THE DRAWINGS

The invention will now be described in greater detail, by way of example with reference to a drawing, in which.

DESCRIPTION OF THE PREFERRED EMBODIMENT

Figure 1:
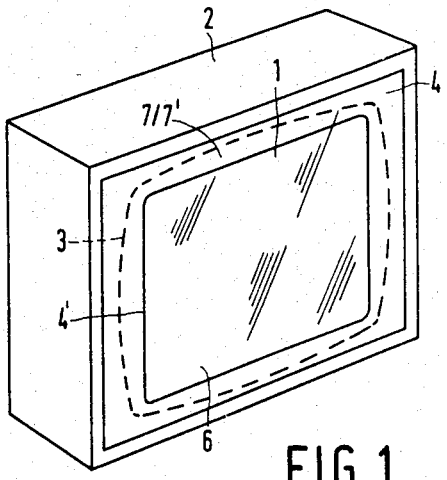
FIG. 1 (PRIOR ART)
FIG. 1 is a perspective view of a prior art television set having a fillet around the display screen.

FIG. 1 is a perspective view of a prior art television set. A display tube having a display window 1 is connected in a cabinet 2 by means of suspension means not shown. Said tube comprises a substantially rectangular display screen on the inner wall of the much less rectangular display window 1 which has a slightly barrel-shaped outer contour 3. As a result of this a dark edge 7, 7' which varies in width is formed around the display screen 6 and is covered by a fillet 4. The inner edge 4' of said fillet to the viewer forms the visual boundary of the luminescent material of the display screen 6 on the inner wall of the display window 1.

Figure 2:
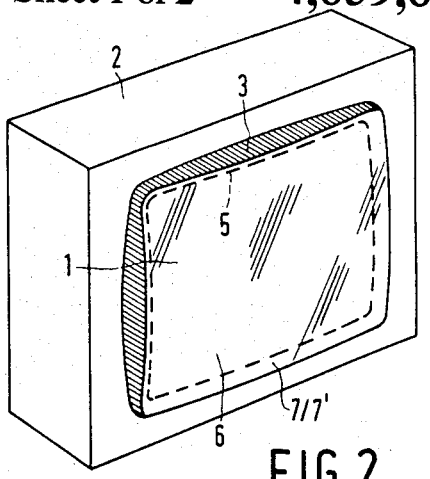
FIG. 2 (PRIOR ART)
FIG. 2 shows a prior art set without a fillet but with push-through mounting of the display tube.

FIG. 2 is a perspective view of a television set in which a display tube of the type as used in the FIG. 1 set is used. In this set the display window 1 slightly projects from the cabinet 2. This is the so-called push-through mounting of the display tube. In this manner of tube mounting the use of the fillet 4 described with reference to FIG. 1 is not possible. The substantially rectangular display screen 6 on the inner wall of the much less rectangular display window 1 bounded by the broken line 5 leads to dark or shining areas 7, 7' above and below and on the left and on the right of the displayed picture, which areas vary in width and are annoying to the viewer. The areas 7 and 7' are dark in the case of a matrix tube and are partly shining (area 7') in the case of a tube in which no matrix material is used because the aluminum present beond the boundary of the luminescent material is visible to the viewer. This is shown more clearly in FIG. 3 which is a front elevation of the tube as is used in the FIG. 2 set. In a tube having an outer diagonal of the display window of 51 cm the distance from the boundary 5 of the display screen 6 (broken line in the figure) to the outer contour 3 of the display window in the diagonal direction was 18.3 mm (indicated by an arow a) and on the centres of the long and short sides it was 26.6 mm (denoted by an arrow b) and 23.8 mm (denoted by an arrow c), respectively.

Figure 4:
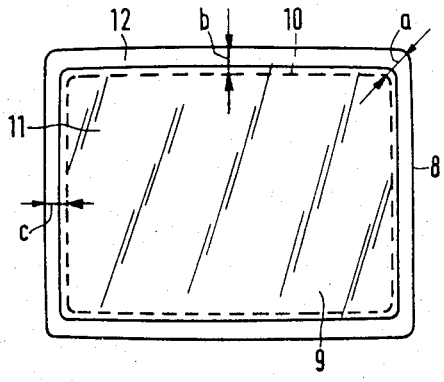
FIG. 4 is a front elevation of a display tube according to the invention.

FIG. 4 is a front elevation of a display tube according to the invention in which the outer contour 8 of the display window 9 is substantially parallel to the boundary 10 of the luminescent material of the display screen 11. As a result of this a dark edge 12 which is uniform in width is obtained around the substantially rectangular display screen 11.

Figure 3:
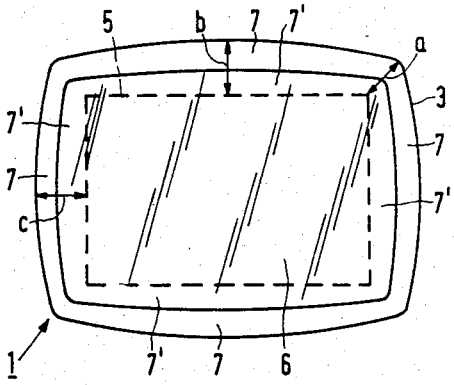
FIG. 3 (PRIOR ART)
FIG. 3 is a front elevation of the display tube of the set shown in FIG. 2.

The values of a, b and c defined in a manner corresponding to that of FIG. 3 are 19.5 and 20.9 and 20.0 mm, respectively. In the tube according to the invention the variation in width of the dark edge is less than 1.5 mm, which is substantially not observable. In the known tube said variation is well over 8 mm, which causes perceptively an annoying effect. The sides of the outer contour 8 have a radius of curvature of approximately 6.5 m.

Figure 5:
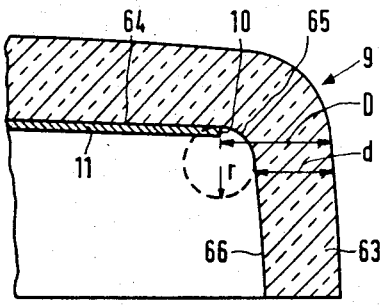
FIG. 5 is a cross-sectional view of a part of the edge and the skirt of the display window of the display tube shown in FIG. 4.

FIG. 5 is a cross-sectional view of a part of the edge and skirt 63 of the display window 9 of the display tube shown in FIG. 4. The inner surface 64 of the display window 9 changes into the inner surface 66 of the skirt 63 via a strongly curved surface 65 having a radius of curvature r. The radius of curvature r of the strongly curved surface 65 is between 3 and 10 mm and in this case is approximately 8 mm. The distance between the boundary 10 of the luminescent material of the display screen 11 and the outer surface of the skirt 63 is denoted by D and in this case was 20.0 mm, while the thickness of the skirt 63 denoted by d is approximately 14.5 mm. The usual thin aluminum fillet, not shown, is vapour-deposited over the luminescent material of the display screen 11. As a result of the small radius of curvature of the strongly curved surface 65 and the extension of the luminescent material of the display screen 11, the aluminum film is visible only in the form of a very narrow edge from the front of the tube. In the case of a matrix tube the part of the aluminum film extending beyond the boundary 10 is concealed from the viewer's eye by black matrix material. It may be seen from FIG. 4 that in that case the dark edge 12 becomes wider only to a very small extent.

Figure 6:
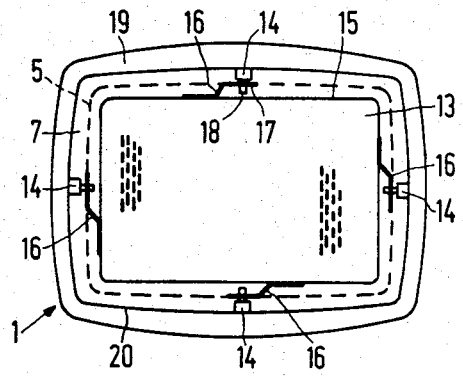
FIG.6 (PRIOR ART)
FIG. 6 is a rear view of a prior art display window in which a shadow mask is suspended from pins sealed to the centres of the sides.

FIG. 6 is a rear view of a prior art display window 1 in which colour selection means in the form of a shadow mask 13 are suspended from metal pins 14 sealed in the centres of the sides of the display window 1. The shadow mask 13 comprises a skirt 15 to which resilient bimetallic strips 16 are welded each having at their free ends 17 an aperture 18 through which the metal pin 14 extends. As a result of the space required for said suspension construction between the skirt 15 of the shadow mask 13 and the skirt of the display window 1, the dark or shining areas 7' which vary in width and are shown in FIG. 3 are formed because the rectangular boundary 5 of the luminescent material of the display screen 6 cannot be provided sufficiently closely along the inner contour 20 of the display window 1. By placing the suspension means in the corner of the display window an optimum size of the display screen on the display window can be realized. Such a construction is shown diagrammatically in FIG. 7 which is a rear view of the display window shown in FIG. 4.

Figure 7:
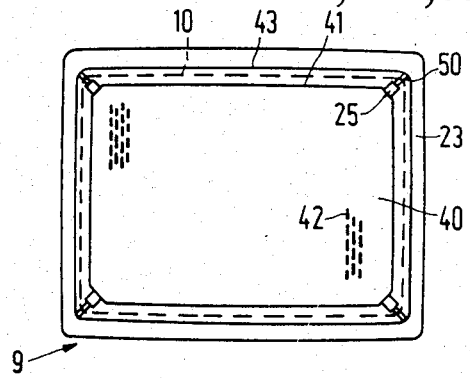
FIG. 7 is a rear view of a display window according to the invention in which a shadow mask is suspended in the corners of the display window.
Figure 8:
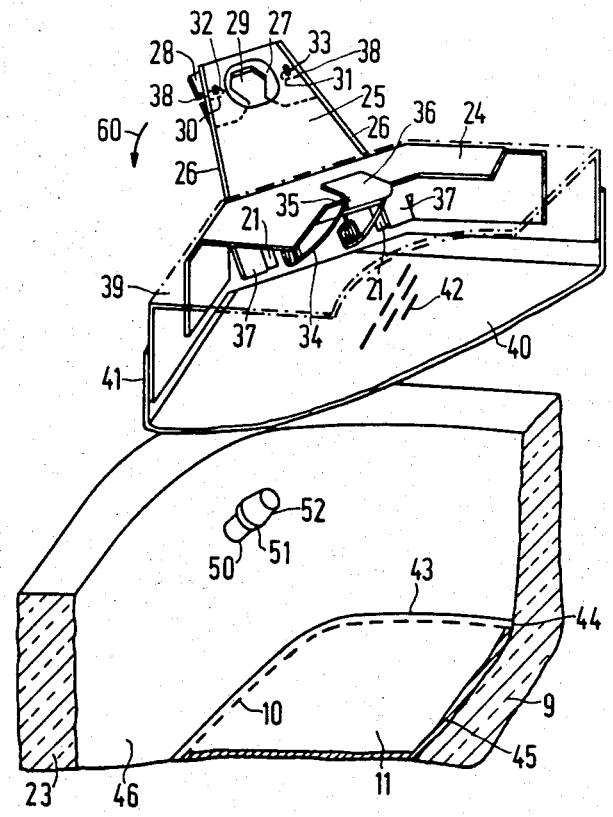
FIG. 8 is a perspective view of a possible suspension construction in a corner of the display window.

FIG. 8 is a perspective view of a possible suspension construction with which the suspension construction shown diagrammatically in FIG. 7 can be realised. A metal pin 50 is sealed in eacn corner of the skirt 23 of the display window 9. A mandrel 51 which has a conical cam 52 is present at the free end of the pin 50. The colour selection means are formed by a thin shadow mask 40 which has a large number of apertures 42 and comprises a skirt 41. A diaphragm 39, shown in broken lines, which prevents reflections of electrons at the skirt 41 is connected to the skirt 41. In order to avoid differences in expansion between the mask 40 and the diaphragm 39, both are manufactured from the same material and in approximately the same thickness (150 $\mu$um). A supporting strip having two lugs 37 is connected in the corner of the diaphragm 39. A thin flat resilient element 25 is connected to the lugs 37 via two narrow lugs 21. The flat element 25 comprises bent-over edges 26 which reinforce it in the longitudinal direction. The flat element moreover is substantially perpendicular to the electron beam deflected towards the corner in question. With a thermal expansion of the shadow mask 40, only the lugs 21 bend through. The remaining part of the element 25 remains flat so that the element 25 substantially pivots about the end connected to the lugs 37. Near the end remote from the supporting strip 24 a slot-shaped aperture 27 is provided in the flat resilient element 25. Said aperture 27 is covered partly by means of a plate 28 which has an aperture 29 and is connected to the element 25. The function of the plate 28 will be described in detail hereinafter. Beside the slot-shaped aperture 27 in the flat resilient element 25 two apertures 30 and 31 are present through which the bent-over ends 32 and 33 of a wire spring 34 shown only partly in the figure extend. The other end 35 of the wire spring 34 is clamped against a bent-over lug 36 which is connected to the supporting strip 24. In this manner the wire spring 34 is connected so as to be tensioned between the supporting strip 24 and the end of the flat resilient element 25 remote from the supporting strip 24. The wire spring 34 further is entirely loose from the flat resilient element 25. The supporting strip 24 furthermore comprises an abutment not visible in the drawing which limits the pivoting movement in the direction of the arrow 60 of the flat resilient element 25.

The shadow mask 40 is suspended in the display window by placing the resilient elements 25 with the plate 28 with their apertures 29 on the conical cams 52 of the pins 50. The position of the shadow mask 40 with respect to the display window 9 is entirely fixed in this manner by the flat resilient elements 25. The pin 50 is substantially perpendicular to the plane of the resilient element 25 which is urged on the pin 50 by the tensioned wire spring. The wire spring 34 ensures that the resilient element 25 after the occurrence of vibrations always again assumes the same position on the cam 52 of the pin 50. The apertures 30 and 31 in which the bent-over ends 32 and 33 of the wire spring 34 are hooked are in one line with the centre of the aperture 27. The point of engagement of the tensile forces of the wire spring 34 hence coincides with the axis of the cam 52 so that the wire spring 54 cannot exert a moment on the flat resilient element 25 as a result of which the position of the element 25 might vary with respect to the cam 52. The flat resilient element 25 is connected at such an angle to the shadow mask 40 that it is substantially perpendicular to the electron beams deflected towards the corner of the display window 9. When the shadow mask 40 expands a smaller distance is necessary between the shadow mask 40 and the display window 9 to keep a colour-pure picture. Since the flat resilient elements 25 are connected to the shadow mask 40 so as to be substantially pivotable, the latter will move in a direction towards the display screen in the case of expansion. The plate 28 serves to compensate for possible tolerances in the position of the pins 50. Each plate 28 comprises two notches 38 through which the bent-over ends 32 and 33 of the wire spring 34 extend. The bent-over ends 32 and 33 of the wire spring 34 journal the plate 28 so that the aperture 29 is kept at the correct height with respect to the slot-shaped aperture 27 in the flat resilient element 25 and the plate 28 can be moved with respect to the flat resilient element 25. After placing the plates 28 on the cams 52, they are connected to the resilient elements 25. As a result of this it is effected that the position of the aperture 29 corresponds accurately with the position of the conical skirt 52. When no loose plates 28 are used, deformation of the shadow mask 40 may occur as a result of differences in the position of the cams 52 and the apertures 27 in the flat resilient elements 25. After the mask ring 23 with the resilient elements 25 has been suspended in the display window 9 in the above-described manner, the mask 40 is laid in the display window 9 with the interposition of a spacing jig after which the diaphragm 39 is welded to the skirt 41 of the mask 40.

After the display window 9 has been provided in the above-described manner with a shadow mask to match, said display window is provided with a display screen 11 in the conventional manner. By using the invention the space between the skirt 23 of the display window 9 and the skirt 41 of the shadow mask 40 may be chosen to be smaller than in the tubes known so far. As a result of this it is possible to make the inner contour 43 of the display window substantially rectangular and to cause the rectangular boundary 10 of the luminescent material of the display screen to extend substantially parallel and at a short distance from the inner contour 43. Said inner contour is formed by a line of points where the inner surface 45 of the window 9 changes into a strongly curved surface 44 having a radius of curvature between 3 and 10 mm. The boundary 10 of the luminescent material of the display screen 11 coincides or coincides substantially with said inner contour.

It will be obvious that the invention is not restricted to the embodiment of the suspension construction of the shadow mask described in Netherlands Patent Application No. 81.02182 (PHN 10.036). Other suspension constructions such as those described for example in Netherlands Patent Applications Nos. 80.04173 (PHN 9810); 80.03611 (PHN 9771) and 80.03609 (PHN 9773) may also be used.

For further information reference is made to the Netherlands Patent Applications Nos. 8304178) (PHN 10.874); 8304180 (PHN 10,876) and 8304181 (PHN 10,877) filed simultaneously with the present application.

What is claimed is:

1. In a color display tube including an envelope having a neck, a cone and a substantially flat display window which changes into a skirt, said skirt being substantially parallel to the axis of the envelope, by means of a strongly curved portion, an inner surface of the display window changing into the inner surface of said skirt by means of a first strongly curved surface having a radius of curvature r and the outer surface of said display window changing into the outer surface of said skirt by means of a second strongly curved surface, said skirt in proximity of said transition having a thickness d, said display window having on its inside surface a substantially rectangular display screen including a material luminescing in at least one color, color selection means positioned in front of said display screen, and means in said neck to generate at least one electron beam, said display window having a distance D in a plane perpendicular to said tube axis, between the boundary of said luminescent material of said display screen and said outer surface of said skirt of said display window, the improvement wherein D is substantially equal throughout the circumference of said display window, and wherein the radius r is equal to or less than 10 mm and $(D-d)/r$ is equal to or less than one.

2. A color display tube as claimed in claim 1, and further comprising suspension means, said suspension means being fixed in the corners of said skirt and positioning said color selection means in front of said display screen.

* * * * *